US006120358A

United States Patent [19]

Porter

[11] Patent Number: 6,120,358

[45] Date of Patent: Sep. 19, 2000

[54] APPARATUS AND METHOD FOR GRINDING A PUNCH

[75] Inventor: James W. Porter, Brighton, Mich.

[73] Assignee: Lane Punch Corporation, Canton, Mich.

[21] Appl. No.: 09/253,271

[22] Filed: Feb. 19, 1999

Related U.S. Application Data

[60] Provisional application No. 60/075,243, Feb. 19, 1998.

[51] Int. Cl.[7] ..... B24B 1/00; B24B 41/06

[52] U.S. Cl. ..... 451/57; 451/403; 451/49; 451/58

[58] Field of Search ..... 451/48, 49, 51, 451/57, 58, 180, 214, 231, 249, 332, 365, 398, 403, 413

[56] References Cited

U.S. PATENT DOCUMENTS

| | | | |
|---|---|---|---|
| D. 351,395 | 10/1994 | Moellering | D15/140 |
| 2,364,733 | 12/1944 | McCollum | 164/124 |
| 3,106,122 | 10/1963 | Newcomb | 83/698 |
| 3,137,193 | 6/1964 | Whistler, Sr. | 83/685 |
| 3,378,912 | 4/1968 | Wallace | 29/419 |
| 3,535,967 | 10/1970 | Whistler, Sr. | 83/698 |
| 3,563,124 | 2/1971 | Gargrave | 83/698 |
| 3,589,226 | 6/1971 | Shadowens, Jr. | 83/143 |
| 4,103,574 | 8/1978 | Greer | 83/140 |
| 4,558,620 | 12/1985 | Wallis | 83/698 |
| 4,584,795 | 4/1986 | Akabane | 51/165.71 |
| 4,635,405 | 1/1987 | Stump | 451/292 |
| 4,829,716 | 5/1989 | Ueda et al. | 451/292 |
| 4,860,413 | 8/1989 | Woodward | 29/38 C |
| 5,038,599 | 8/1991 | Wellman | 72/481 |
| 5,357,835 | 10/1994 | Moellering | 83/698.31 |
| 5,384,991 | 1/1995 | Lee | 451/57 |
| 5,410,932 | 5/1995 | Moellering | 83/698.31 |
| 5,466,102 | 11/1995 | Erickson | 409/232 |

OTHER PUBLICATIONS

Moeller Manufacturing Company Advertisement, Unplug Ball–Lock Retainer Problems, Mar./Apr. 1997.

*Primary Examiner*—Rodney A. Butler
*Attorney, Agent, or Firm*—Young & Basile, P.C.

[57] ABSTRACT

An apparatus for automating the machining operations required to form a teardrop shaped recess in a cylindrical member, such as provided for punches. The apparatus includes a four station turntable assembly, the four stations include a loading/retrieving station and three work stations approximately spaced 90° from adjacent stations. The three work stations each include a grinding tool movable in a horizontal and vertical direction to control the machining of the cylindrical member. The turntable rotates the workpiece from one station to another station.

18 Claims, 2 Drawing Sheets

APPARATUS AND METHOD FOR GRINDING A PUNCH

This appln claims benefit of provisional appln 60/075,243 Feb. 19, 1998.

FIELD OF THE INVENTION

The present invention relates to an automated machine and method for forming teardrop shaped recesses on cylindrical workpieces.

BACKGROUND OF THE INVENTION

To punch holes in metal parts, each punch is generally mounted in a retainer which is in turn mounted on a die shoe located in a press. Typically, the punch retainer comprises a steel body having a through bore in which the punch is removably secured. Within the body of the punch retainer there is formed a circular bore which is perpendicular to the top face of the body. A circular cylindrical shank having a punch is releasibly retained in the bore by means of a ball and spring. For punch retention, the shank of the punch is provided in the outside thereof with a groove forming an arcuate recessed surface. The recessed surface is positioned opposite the opening from the lower end of the bore. The ball engages an inwardly inclined face portion of the punch shank, referred to as a ball seat. The preferred recess shape of the ball seat resembles a teardrop. The ball is biased into engagement with the ball seat by the compression spring which loads the ball to secure the punch in place.

Currently, the ball seat in the shank of the punch is formed manually by precisely drilling the groove or recess into the shank. This can be a time consuming and labor intensive process. Therefore, it is desirable to automate the method for grinding the recess into the punch or other cylindrical workpieces.

SUMMARY OF THE INVENTION

The current invention addresses the aforementioned concerns. The invention includes a four station turntable assembly. At the first station, workpieces to be machined are loaded and clamped into place. The workpieces are held at an angle with respect to the other three work stations. A turntable rotates the workpiece through approximately 90° to the second station where a first grinding tool is positioned to engage the workpiece. The grinding tool is movable along a horizontal axis by a motor and threaded drive shaft or screw. The grinding or machining tool is also movable in a vertical direction by another motor and threaded shaft or screw. While the first grinding tool is machining the workpiece, another part may be loaded at the first station. After the first grinding tool has finished performing the machining operation at the second station, the turntable rotates to approximately 90° to position the first workpiece at the third station and the second workpiece, if applicable, to the second station. Simultaneously, another workpiece may be loaded at the first station. The third station actuates a second grinding tool simultaneously with the grinding tools at the other work stations to machine the workpiece. The horizontal and vertical movement of the second grinding tool are controlled by another pair of motors in the same manner as described for the first grinding tool located at the second station. After the first and second grinding tools have finished their machining operations, the turntable rotates through approximately 90° to sequentially move the workpieces between the work stations positioning the workpiece previously at station three to its appropriate position for machining at station four. The grinding machine at station four also has a pair of motors for operation along horizontal and vertical axes as previously described to machine the workpiece. After the machining operation is completed at the fourth station, the turntable rotates through approximately 90° to sequentially move the workpieces to the next station. The workpiece finished at station number four is delivered to station one for removal prior to the operator inserting a blank workpiece to be sent to the second station. Each of the three work stations grind a portion of the same recess to provide a finished workpiece leaving the last work station.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 2:
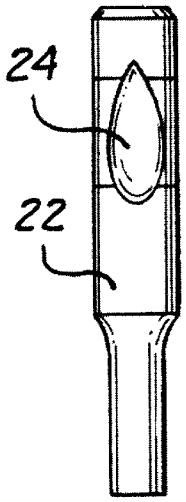
FIG. 2 is a view of a recessed ball seat in a punch shank formed by the apparatus and method of the present invention.
Figure 1:
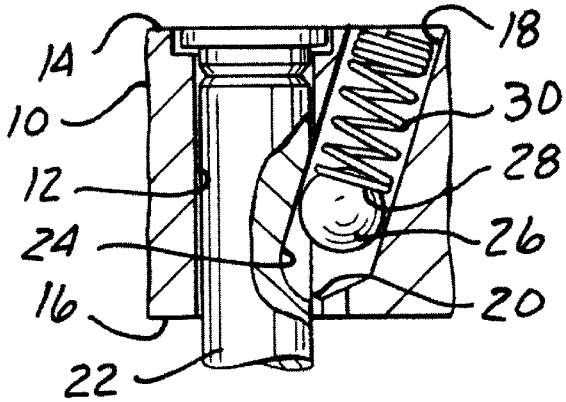
FIG. 1 is an elevational view of a punch assembly displaying a typical use of a grooved punch shank formed by the apparatus and method of the present invention.

FIG. 1 shows a portion of a punch retainer unit which forms part of a punch installation. The retainer body 10 includes a vertical opening forming a bore 12. At the upper and lower ends of the body are a pair of flat planar parallel surfaces 14 and 16. At the upper surface 14 is a second bore 18. The second bore 18 has its innermost end 20 open at one side to the first bore 12. The second bore 18 is oriented such that it intersects the first bore 12 at an acute angle. The first bore 12 accommodates the shank of a piercing punch element 22 which projects through and beyond the lower parallel surface to have its operating end positioned adjacent a piece of metal (not shown). The punch element 22 is provided with a teardrop shaped arcuate recess surface 24 that is positioned opposite the opening from the lower end of the second bore. Seated in the lower end of the second bore 18 is a ball element 26. A portion of the ball element 26 projects through the opening of the second bore 18 into the first bore 12 and engages in the recessed surface 28 of a compression spring 30 which loads the ball 26 for securing the punch 22 in place. FIG. 2 shows the teardrop shaped recess 24 in a shank 22 similar to the shank used in the punch assembly of FIG. 1.

Figure 3:
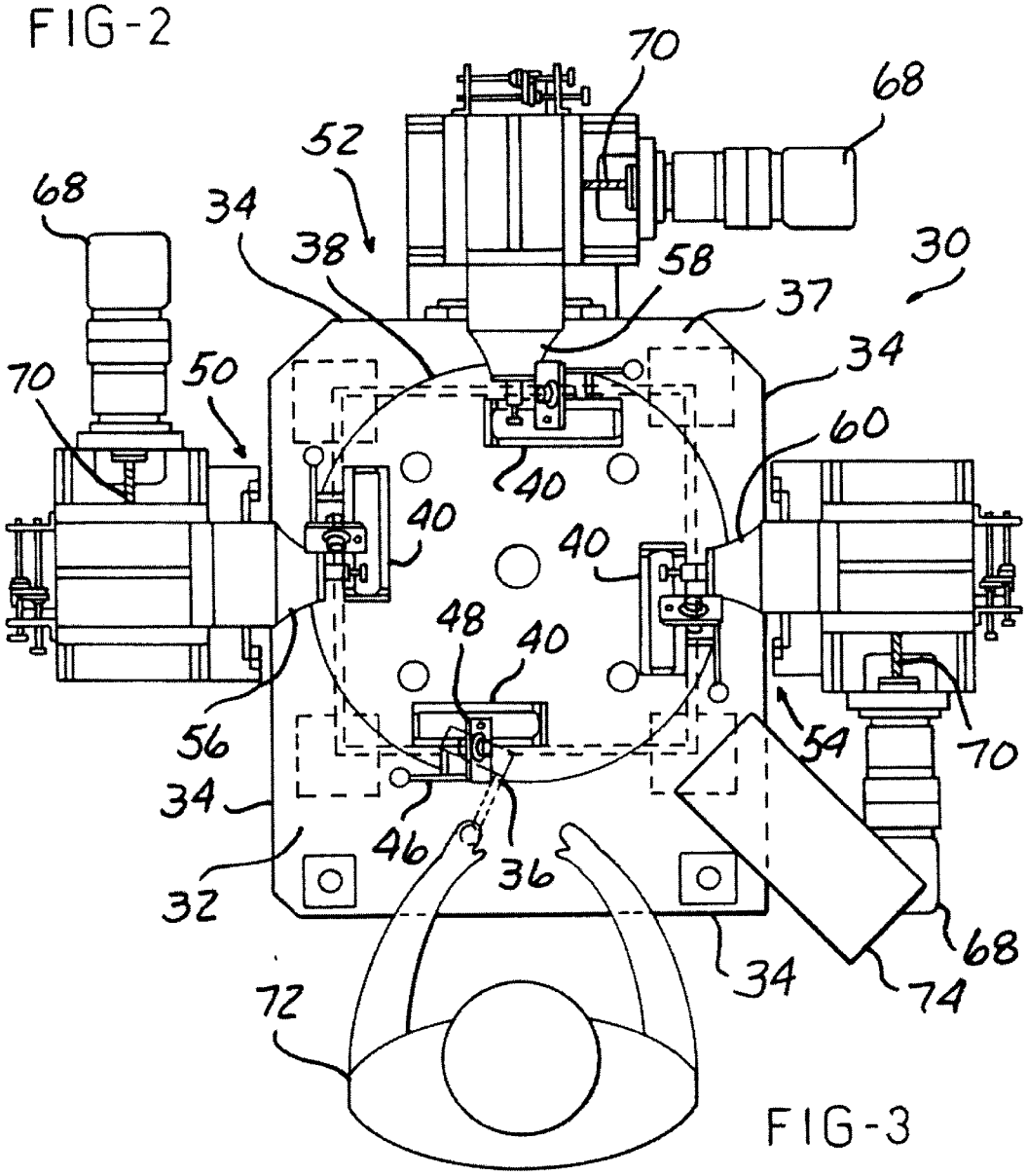
FIG. 3 is a plan view of an automatic machining device for forming the recessed ball seat of the present invention.
Figure 4:
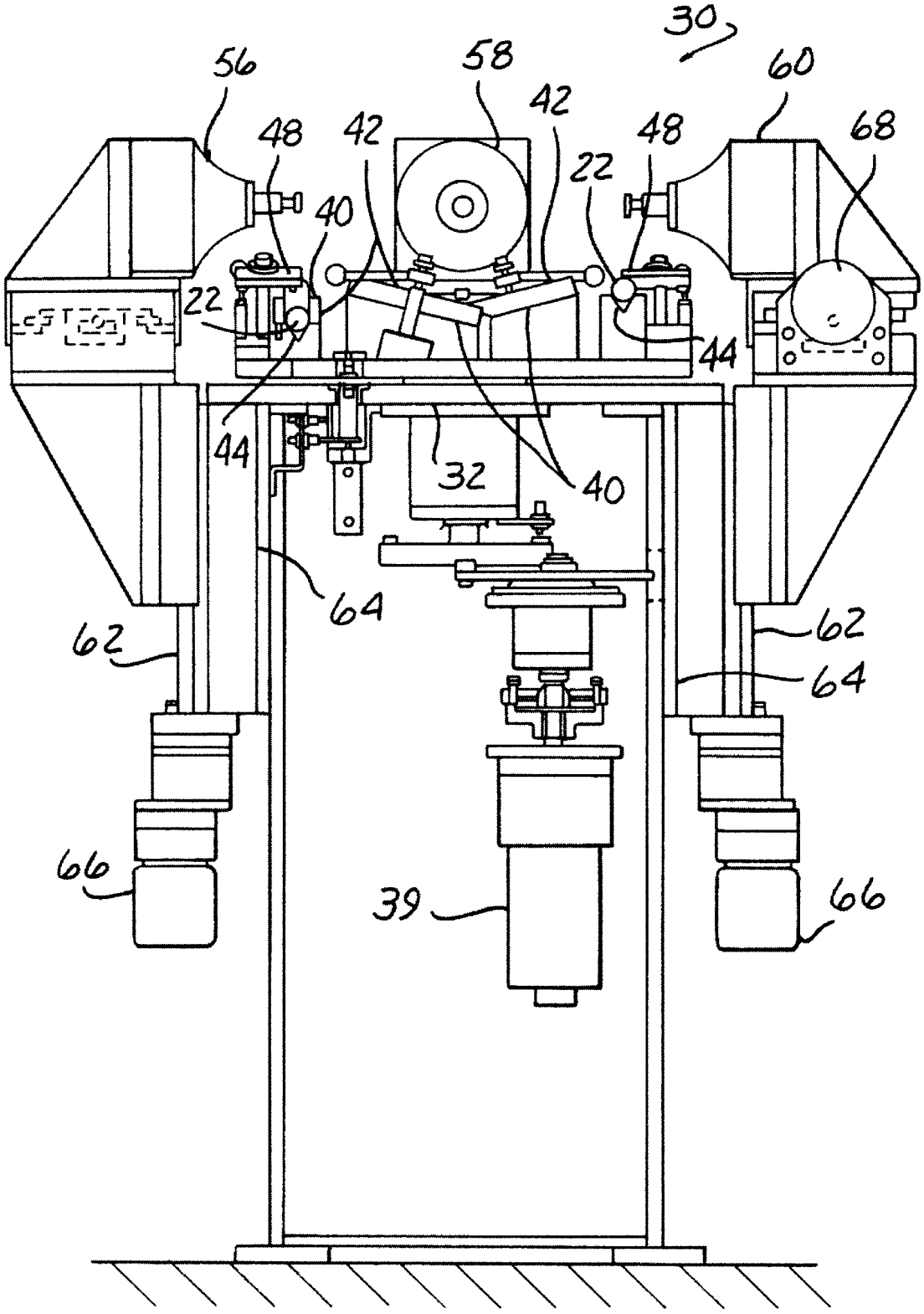
FIG. 4 is a side elevational view of the machining device shown in FIG. 3.

FIGS. 3 and 4 show the apparatus 30 of the current invention that provides the automated means for grinding the teardropped recess 24 into a workpiece 22 as shown in FIG. 2. The apparatus 30 includes a elevated platform or table 32 having a generally rectangular shape. On each peripheral side 34 of the table 32 is a station. The first station 36 is a loading and retrieving station 36 where the workpiece 22, such as a punch element, is manually loaded or removed from the apparatus 30. In the center of the top planar surface 37 of the table 32 is a selectively revolving circular turntable 38. A motor 39 rotates the turntable 38. Spaced on the turntable 38 at approximately 90° , are located four carriers 40. Each carrier 40 is identical to another carrier, and therefore only one will be described. Each carrier 40 has an elevated angled base 42 as shown more clearly in FIG. 4. The angled base 42 has a top surface with a V-shaped crevice 44 for receiving the cylindrical workpiece 22. A manually rotatable handle 46 attached to a locking bar 48 moves the locking bar 48 upon rotation to overlay the workpiece 22 while it is located on the carrier 40. FIG. 3 at the first station 36 shows the handle 46 in locking mode in phantom. The carrier 40 is angled at a predetermined level to provide maximum access to the specified surface portion of the workpiece 22 for the individual grinding tools.

The second, third and fourth stations 50, 52, 54 respectively are work stations. Each work station has a grinding tool 56, 58, 60 respectively, movable in the horizontal as well as vertical directions. The grinding tools 56, 58, 60 are similar at each work station, except possibly for the grain of the machining device. Therefore, only the first grinding tool 56 at the second station will be discussed in detail. The grinding tool 56 is mounted to a vertical shaft 62 that in turn communicates to the table 32 via a mount 64. A motor 66 communicating with the mount 64 and the shaft 62 drives the grinder tool 56 in an up or down direction. The shaft 62 is preferably a threaded screw. The grinder tool 56 is further in communication with a second motor 68 and drive shaft 70, shown better in FIG. 3. The second drive shaft 70 and motor 68 are connected to a side portion of the grinder tool 56. The second drive shaft 70 is preferably a threaded drive screw similar to the first threaded drive screw 62. The motor 68 maneuvers the second drive screw 70 to move the grinder tool 56 in a horizontal direction.

The third and fourth stations 52, 54 respectively, include the identical components as the second station 50. Therefore, each of the stations include a first motor 66 and drive shaft 62 to move their respective grinding tool 58 and 60 in a reciprocating vertical direction. Each of the stations also have a second motor 68 and second shaft 70 to move their respective grinding tool 58 and 60 in a reciprocating horizontal direction. The only difference of the three work stations 52, 54, 56 would be that the grinding point may have a specific grade/grit to grind the predetermined portion of the recess.

To automate the process of grinding the teardrop shaped recess 24 in the cylindrical workpiece 22, one operator 72 is needed for the setup and retrieval of the workpiece 22 at each apparatus 30. As shown in FIG. 3, the operator 72 is situated at the first station 36 to load the workpiece 22 onto the adjacent carrier 40 of the apparatus 30. The turntable 38 moves 90° so that the first workpiece 22 is now situated at the second station 50. The motors 66, 68 for the grinding tool 50 as well as the motor 39 rotating the turntable 38 are controlled by a computer 74. Therefore, the grinding tool 56 at the second station 50 will be moved horizontally and vertically as controlled by the computer 74 to grind the predetermined portion of the teardrop shaped recess 24. As the workpiece 22 is being ground at the second station 50, the operator 72 can then fill the next empty carrier 40 at his station 36. Once grinding is completed at the second station 50, the computer 74 will activate motor 39 to revolve the turntable 38 another 90° such that the first workpiece is at the next work station (third station 52) and the second workpiece is now at the second station 50. The operator 72 will then fill the empty carrier 40 at his station 36. Grinding portions will be completed at each of the three work stations (stations 50, 52, 54). When the first workpiece has completed its last station grinding procedure, and the other work stations have completed their grinding procedures of their subsequent workpieces, the computer 74 again activates motor 39 to revolve the turntable 38 such that the completed first workpiece 22 is again in front of the operator 72. When a completed workpiece is positioned in front of person 72, he will remove the lock mechanism 48 by manually shifting the handle 46 away from the workpiece 22. The operator 72 will remove the completed workpiece 22 from the carrier 40 and install a new unfinished workpiece to the carrier 40 and lock it therein. As a result, three workpieces can be machined simultaneously while a fourth workpiece is in a holding position at the first station.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An automated method for forming a teardrop shaped recess on a cylindrical workpiece, the steps comprising:

securing the workpiece adjacent to a first station;

rotating the workpiece to a second work station, wherein the second work station has a first grinding tool;

positioning the first grinding tool to engage the workpiece;

activating the first grinding tool to grind a portion of the recess into the workpiece;

rotating the workpiece to a second work station, wherein the third work station has a second grinding tool;

positioning the second grinding tool to engage the workpiece;

activating the second grinding tool to grind another portion of the recess into the workpiece;

rotating the workpiece to a fourth work station, wherein the fourth work station has a third grinding tool;

positioning the third grinding tool to engage the workpiece;

activating the third grinding tool to grind another portion of the recess into the workpiece;

rotating the workpiece to the first work station; and removing the workpiece from the first work station.

2. The method of claim 1, wherein the step of activating the first grinding tool includes the steps of moving the first grinding tool along a horizontal axis and moving the first grinding tool in a vertical direction.

3. The method of claim 2, wherein the step of moving the grinding tool along a horizontal axis includes driving a threaded shaft connected to the first grinding tool in the horizontal direction with a motor.

4. The method of claim 2, wherein the step of moving the grinding tool in a vertical direction includes driving a threaded shaft connected to the first grinding tool in a vertical direction with a motor.

5. The method of claim 1, wherein the steps of rotating the workpiece includes providing a turntable assembly.

6. An apparatus for forming a teardrop shaped recess on a cylindrical workpiece comprising:

a first work station;

means for securing the workpiece adjacent to the first work station:

a second work station spaced from the first work station, wherein the second work station has a first grinding tool movable to engage the workpiece and to grind a portion of the teardrop shaped recess;

a third work station spaced from the second work station and having a second grinding tool, wherein said second grinding tool is movable to engage the workpiece and to grind a second portion of the teardrop shaped recess;

a fourth work station spaced from the third work station and having a third grinding tool, wherein said third grinding tool is movable to engage the workpiece and to grind a third portion of the teardrop shaped recess; and means for rotating the workpiece from one of the work stations to another of the work stations.

7. The apparatus of claim 6 further including means for rotating the workpiece sequentially to the work stations.

8. The apparatus of claim 6 further including means to move the first, second and third grinding tools in horizontal and vertical directions.

9. The apparatus of claim 8, wherein the means to move the first, second and third grinding tools includes individual motors and drive shafts to move each grinding tool in the horizontal direction and individual motors and drive shafts to move each grinding tool in the vertical direction.

10. An apparatus for forming a teardrop shaped recess on a cylindrical workpiece comprising:

means for loading and clamping the workpiece to the apparatus;

a plurality of work stations each having a grinding tool wherein at least one grinding tool is vertically and horizontally moveable when grinding the teardrop shaped recess in the workpiece, means for moving the workpiece from one work station to another work station.

11. The apparatus of claim 10, wherein each work station is spaced generally 90° from the adjacent work station.

12. The apparatus of claim 11 further including means to rotate the workpiece to adjacent work stations.

13. The apparatus of claim 12, wherein the means to rotate includes a turntable assembly communicating with the loaded and clamped workpiece.

14. An apparatus for forming a teardrop shaped recess on a cylindrical workpiece comprising:

a nest for receiving and for holding at least one cylindrical workpiece in a predetermined angled orientation with respect to a horizontal plane;

at least one work station having a grinding tool moveable along a predetermined path; and at least one motor for moving the grinding tool along the path and into engagement with the at least one cylindrical workpiece at the work station for forming a teardrop shaped recess in a predetermined location on the cylindrical workpiece.

15. The apparatus of claim 14 further comprising:

the predetermined path of the grinding tool having vertical and horizontal components.

16. The apparatus of claim 14 further comprising:

the predetermined path programmable for selectively producing a plurality of different teardrop shapes and sizes on a plurality of different cylindrical workpiece sizes.

17. The apparatus of claim 14 further comprising:

the at least one motor including a first motor for controlling movement of the grinding tool in a first direction and a second motor for controlling movement of the grinding tool in a second direction perpendicular to the first direction.

18. The apparatus of claim 14 further comprising:

the at least one work station including a plurality of workstations spaced from one another; and means for moving at least one cylindrical workpiece from one work station to another work station.

* * * * *